US007699079B2

(12) United States Patent
Schall et al.

(10) Patent No.: US 7,699,079 B2
(45) Date of Patent: Apr. 20, 2010

(54) BULK TRANSPORT SYSTEM

(75) Inventors: Kirk Matthew Schall, Memphis, TN (US); James David Allison, Memphis, TN (US); Mark Alan Jones, Brentwood, TN (US); Malcolm Lindsay Felmingham, Norfolk (GB)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/206,777

(22) Filed: Sep. 9, 2008

(65) Prior Publication Data

US 2009/0010098 A1 Jan. 8, 2009

Related U.S. Application Data

(62) Division of application No. 11/012,031, filed on Dec. 14, 2004, now Pat. No. 7,438,461.

(60) Provisional application No. 60/540,539, filed on Jan. 29, 2004.

(51) Int. Cl.
*B65B 1/20* (2006.01)

(52) U.S. Cl. ..... 141/12

(58) Field of Classification Search ..... 366/173.1, 366/173.2; 222/105, 145.5; 383/41, 45, 383/100, 904, 906; 141/11, 12
See application file for complete search history.

(56) References Cited

U.S. PATENT DOCUMENTS 3,421,665 A * 1/1969 Paton ..... 222/386.5
3,451,724 A * 6/1969 Cappelli et al. ..... 406/137
3,512,842 A 5/1970 Milewski et al.
3,759,279 A 9/1973 Smith, Jr.
3,799,620 A 3/1974 Robinson et al.
3,868,042 A 2/1975 Bodenheimer et al.
3,884,373 A 5/1975 Archibald (Continued)

FOREIGN PATENT DOCUMENTS

GB 597 015 A 9/1953

(Continued)

OTHER PUBLICATIONS

DuPont Sodium Cyanide Excel II Solution Systems, *Providing solid-to-solution delivery of sodium cyanide*, one page, undated , 1 page.

(Continued)

*Primary Examiner*—Tony G Soohoo

(57) ABSTRACT

A flexible bulk container capable of transporting a first material and introducing a second material for mixing therewithin is disclosed wherein 1) said container can comprise a component of a bulk transport system further comprising a container assembly, and 2) said container includes a body defining a cavity, at least one opening, at least one vent, and a material delivery system assembly wherein a) the body is flexible and capable of positioning within the container assembly, b) the opening provides communication with the cavity, and c) the material delivery system assembly comprises at least one manifold, a portion of which is positioned within the cavity of the flexible bulk container, and said manifold includes a shell, an interior region, an inlet accessible from outside of the cavity of the flexible bulk container and at least one passageway extending from the internal region, through the shell, to, in turn, place the interior of the manifold in communication with the cavity.

23 Claims, 10 Drawing Sheets

U.S. PATENT DOCUMENTS

| | | | |
|---|---|---|---|
| RE32,354 | E | 2/1987 | Savage |
| 4,717,120 | A | 1/1988 | Fremow et al. |
| 5,000,359 | A | 3/1991 | Scholle et al. |
| 5,110,366 | A | 5/1992 | McGregor |
| 5,222,512 | A | 6/1993 | McGregor |
| 5,470,150 | A | 11/1995 | Pardikes et al. |
| 5,487,485 | A | 1/1996 | Yang et al. |
| 5,586,690 | A | 12/1996 | Ettore et al. |
| 5,680,959 | A | 10/1997 | Ettore et al. |
| 5,690,253 | A | 11/1997 | LaFleur |
| 5,823,670 | A | 10/1998 | Rushing et al. |
| 5,890,616 | A | 4/1999 | Cravens et al. |
| 6,007,233 | A | 12/1999 | Cairns |
| 6,138,878 | A | 10/2000 | Savage et al. |
| 6,224,250 | B1 | 5/2001 | Kreinheder et al. |
| 6,276,826 | B1 | 8/2001 | Rumph |
| 6,305,845 | B1 | 10/2001 | Narin |
| 6,467,652 | B2 | 10/2002 | Wilcox et al. |
| 6,637,469 | B2 | 10/2003 | Hoffman et al. |

FOREIGN PATENT DOCUMENTS

| | | | |
|---|---|---|---|
| WO | WO 01/07328 | A1 | 2/2001 |
| WO | WO 01/44072 | A1 | 6/2001 |
| WO | WO 02/051236 | A | 7/2002 |

OTHER PUBLICATIONS

Brochure: JW Automarine The Weight Lifters brochure, Crestbury Limited, Designers and fabricators of coated fabric and film products, undated, 13 pages.

Brochure: Scholle flexible packaging solutions, 2002 Scholle Corporations 6 pages.

* cited by examiner

BULK TRANSPORT SYSTEM

CROSS-REFERENCE TO RELATED APPLICATION

This application claims priority to U.S. Provisional Application No. 60/540,539 filed on Jan. 29, 2004.

FIELD OF THE INVENTION

The present invention relates in general to a bulk transport system, and more particularly a bulk transport system which is capable of transporting materials in bulk in a flexible container, and subsequently having a second material, preferably a fluid, introduced into the container to reduce in viscosity, reduce in density, or dissolve the bulk material for subsequent removal thereof from the container.

BACKGROUND OF THE INVENTION

Increasingly, certain dry materials are shipped in flexible bulk containers to end-users. Certain of these dry goods are hydrated (or dissolved) prior to use by the end user. To achieve the hydration of the dry goods by the end user, the end user first opens and empties a number of the containers into a mixing vat prior to hydration or dissolution. Once dissolved, the end mixture is drained from the vat for use. Flexible containers can only partially tolerate the pressure that may be generated during dissolution of a viscous or solid material within the container.

Among other drawbacks, the emptying and mixing procedures are costly, time consuming and tedious. Specifically, the containers are relatively small thus a great number of containers must be shipped, opened and emptied by the end user. Furthermore, inasmuch as the chemicals carried by the bulk containers are often hazardous, a danger to operators occurs every time the material is moved from container to a second container (i.e., vat). Additionally, the disposal of the used containers contaminated with hazardous dry goods has become increasingly regulated, costly and difficult.

Certain solutions have been developed to limit the handling of the dry material by the end user. One such system, developed by E. I. du Pont de Nemours and Company, Wilmington, Del., and marketed under the trademark Excel II, utilizes a highly specialized tanker truck to carry the dry material and as a mixing chamber for mixing the dry material with liquid such as water. The tanker truck is adapted to include a series of jets, which are capable of spraying liquid within the tanker at the dry material. Once the dry material is dissolved, the tanker is emptied and cleaned.

While such a solution has been quite advantageous for certain situations, there are nevertheless drawbacks. One problem has been that once emptied, the taker must be returned in an empty condition to the dispenser of the dry material. Furthermore, the specialized tanker trucks are not suitable for transport by rail or by ship. As such, the use of the system is confined to a region, which is reachable, by tanker truck using roads. Further still, the tanker trucks outfitted with the highly specialized equipment for receiving liquid and dissolving the dry material are expensive to manufacture and maintain.

Accordingly, it is desirable to have a flexible bulk container which is capable of transporting dry or viscous material and also capable of receiving a fluid for dissolving, reducing the density, or reducing the viscosity of the material within the container for eventual use thereof. It is also desirable to have a bulk transport system which utilizes a collapsible and reusable flexible bulk container as a liner assembly housed within an outer container that is transportable in a number of different manners. The present invention provides such a transport system.

SUMMARY OF THE INVENTION

The present invention comprises a flexible bulk container capable of transporting a first material and introducing a second material for mixing therewithin, comprising:

- a body defining a cavity;
- at least one opening and at least one vent, each providing communication with the cavity; and
- a material delivery system assembly having:
  - at least one manifold, a portion of which is positioned within the cavity of the flexible bulk container, the at least one manifold having a shell, an interior region and an inlet accessible from outside of the cavity of the flexible bulk container, and at least one passageway extending from the internal region, through the shell, to, in turn, place the interior of the manifold in communication with the cavity.

The present invention further comprises a bulk transport system capable of transporting a first material and introducing a second material for mixing therewithin, comprising:

- a container assembly; and
- a liner assembly having:
  - a body defining a cavity, the body being flexible and capable of positioning within the container assembly;
  - at least one opening and at least one vent, each providing communication with the cavity; and
  - a material delivery system assembly having:
    - at least one manifold, a portion of which is positioned within the cavity of the liner assembly, the at least one manifold having a shell, an interior region, an inlet accessible from outside of the cavity of the liner and at least one passageway extending from the internal region, through the shell, to, in turn, place the interior of the manifold in communication with the cavity.

The present invention further comprises a process for dissolving, reducing the density, or reducing the viscosity of a first material comprising the steps of:

- filling with a first material a flexible bulk container comprising:
  - a body defining a cavity;
  - at least one opening and at least one vent, each providing communication with the cavity; and
  - a material delivery system assembly having:
    - at least one manifold, a portion of which is positioned within the cavity of the flexible bulk container, the at least one manifold having a shell, an interior region and an inlet accessible from outside of the cavity of the flexible bulk container and at least one passageway extending from the internal region, through the shell, to, in turn, place the interior of the manifold in communication with the cavity;
- supplying the cavity with a second material through the material delivery system assembly;
- dissolving, reducing in density, or reducing in viscosity the first material by contacting with the second material to form a resulting material;
- venting air and gas through the vent of the flexible bulk container; and
- evacuating the resulting material through the at least one opening of the flexible bulk container.

The present invention further comprises a method for transporting bulk materials comprising the steps of:

providing a container assembly;

providing a liner assembly, the liner assembly comprising:

a body defining a cavity;

at least one opening and at least one vent, each providing communication with the cavity; and a material delivery system assembly having:

at least one manifold, a portion of which is positioned within the cavity of the liner assembly, the at least one manifold having a shell, an interior region and an inlet accessible from outside of the cavity of the liner and at least one passageway extending from the internal region, through the shell, to, in turn, place the interior of the manifold in communication with the cavity;

positioning the liner assembly within the container assembly at a first geographical location;

filling the cavity of the liner assembly with a first material through the at least one opening;

sealing the liner assembly;

transporting the container assembly to a second geographical location;

supplying the cavity of the liner assembly with a second material through the material delivery system assembly;

dissolving, reducing in density, or reducing in viscosity the first material by contacting with the second material to form a resulting material;

venting air and gas through the vent of the liner assembly; and evacuating the resulting material through the at least one opening of the liner assembly.

BRIEF DESCRIPTION OF THE DRAWINGS

The invention will now be described with reference to the drawings wherein.

DETAILED DESCRIPTION OF THE INVENTION

Figure 1:
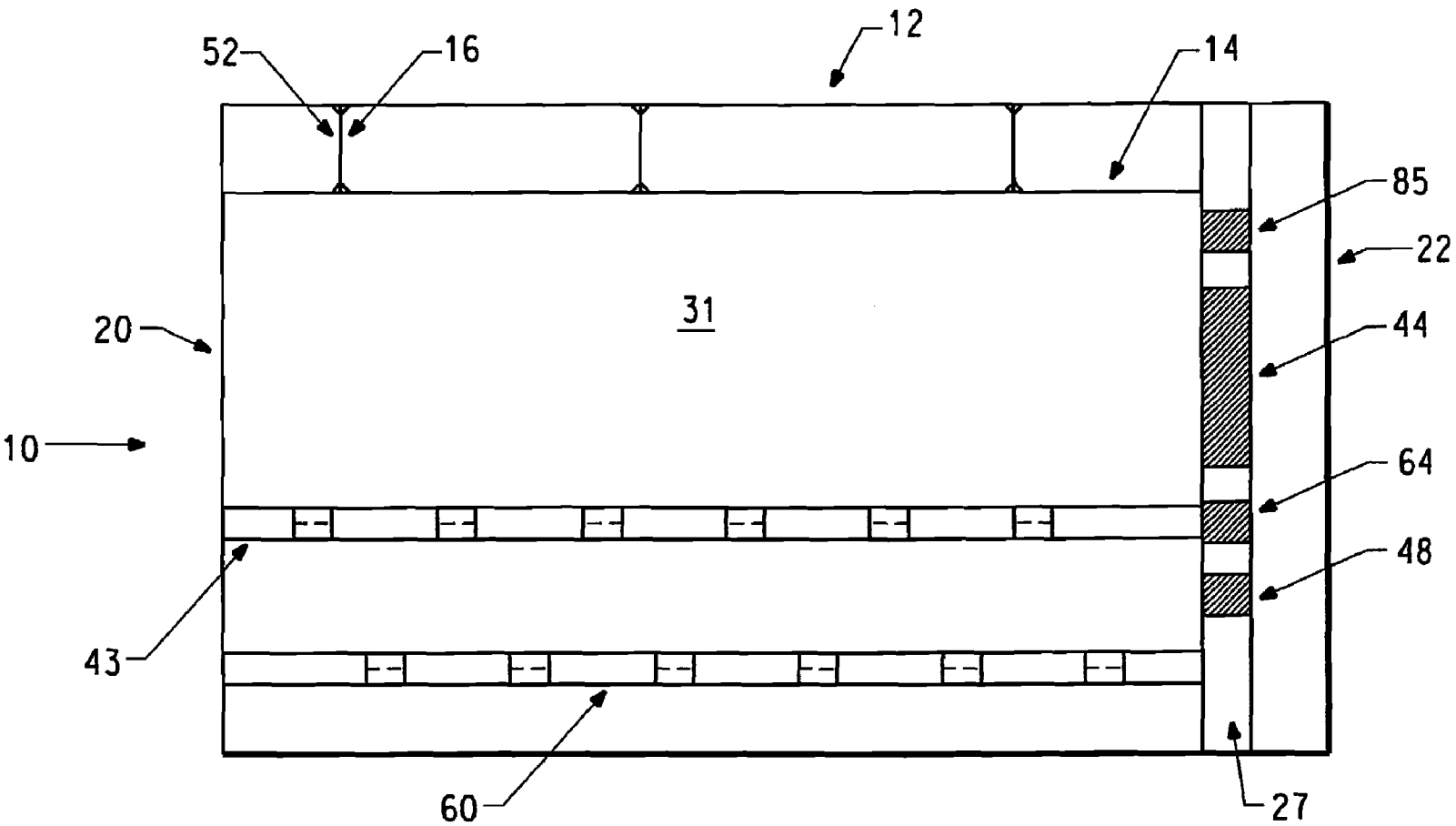
FIG. 1 of the drawings is a cross sectional view of the bulk transport system of the present invention.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

The term "first material" is used herein to indicate a material that is to be dissolved, liquefied, reduced in density, or reduced in viscosity within the flexible bulk container or the bulk transport system.

The term "second material" is used herein to mean a material that is added to the flexible bulk container or to the liner assembly of the bulk transport system containing a first material for the purpose of dissolving, liquefying, reducing the density, or reducing the viscosity of the first material. Preferably the second material is a fluid.

The term "nozzle" is used herein to mean a device to distribute a spray or stream of material, usually under pressure.

The term "liner assembly" as used herein is the flexible bulk container of the present invention.

The invention comprises a flexible bulk container and a bulk transport system capable of transporting a first material and introducing a second material for mixing therewithin. The bulk transport system comprises a container assembly, and a liner assembly. The liner assembly is the flexible bulk container of the present invention and includes a body, at least one opening, at least one vent, and a material delivery system assembly. The body is flexible and capable of positioning within the container assembly. The opening and vent each provide communication with the cavity defined by the body of the flexible bulk container. The material delivery system assembly has at least one manifold, a portion of which is positioned within the cavity of the flexible bulk container. The manifold includes a shell, an interior region, an inlet accessible from outside of the cavity of the flexible bulk container and at least one passageway extending from the internal region, through the shell, to, in turn, place the interior of the manifold in communication with the cavity.

In a preferred embodiment, the container assembly includes a front wall, a back wall, a top wall, a bottom wall and opposing sidewalls. In one such embodiment, the container assembly includes a bulkhead extending between the opposing sidewalls between the front wall and the back wall. The container assembly ranges in size from about one liter in volume up to about 100 metric tons. Examples of particularly preferred container assemblies are rail cars, sea containers, air containers, and truck trailers.

In a preferred embodiment, the body of the flexible bulk container or liner assembly comprises a front wall region, a back wall region, a top wall region, a bottom wall region and opposing side wall regions. The walls comprise a flexible polymeric material or composite material, and can include a number of different layers of laminate or plies of laminate. The walls are impervious both externally and internally with respect to water and other liquids, and internally with respect to the material to be contained therein (first material). Such polymeric materials or composites can have surface coatings and are commercially available. An example of a suitable wall material is a polyester weave coated with polyvinylchloride. The polymer optionally contains ultraviolet inhibiting, antimicrobial inhibiting, moisture absorbing, or other such ingredients compatible with the first material. The polymer has a cloth weight and coating weight suitable for the weight of product to be shipped therein (first material). Specifications for the tensile strength, tear strength and adhesive strength of the polymeric material are based upon the first material and the size of the flexible bulk container or liner assembly and can be determined by those skilled in the art.

The at least one opening of the flexible bulk container comprises an inlet and an outlet. Preferably, in such an embodiment, the inlet is positioned above the outlet on a back panel of the body and the vent is positioned at the top of the back panel. Additionally, in such an embodiment, the inlet includes a fitment and a cover capable of sealing the inlet in a substantially fluid tight configuration. The cover is attached to the flexible bulk container by any number of different structures, including but not limited to heat sealing, RF welding, adhesion or mechanical fastening. An example of the latter is a cover fitted with a screw lock, bolted flange, or other closure. Furthermore, the outlet includes a valve to control flow therethrough. Examples include a ball valve with quick release coupling, a butterfly valve with quick release coupling, a spout assembly with a plug which permits insertion of a probe assembly for flow of material through the probe as described in U.S. Pat. Re. 32,354, or other valve mechanisms known in the art. Moreover, the inlet has a cross-sectional area substantially greater than that of the outlet. Filters, screens or other such mechanisms can be present on the outlet and vent to keep material from plugging other parts of the system during filling and evacuation of the flexible bulk container. The vent is present for relief of excess pressure and trapped air or gas. Preferably the opening and closing of the vent is controlled by an automatic mechanism.

In another preferred embodiment, the at least one manifold comprises a plurality of manifolds. Preferably the at least one passageway comprises a plurality of passageways strategically positioned along the manifold. In one such embodiment, each of the plurality of manifolds has a first end having an inlet coupled with a back wall region of the liner assembly and a second end extending toward the front wall of the liner assembly. In another preferred embodiment, the at least one manifold is coupled to the liner assembly at the inlet of the at least one manifold.

In another preferred embodiment, at least a portion of the at least one manifold extends proximate to a bottom wall region of the liner assembly. Preferably, the at least one manifold comprises a plurality of manifolds, at least two of the plurality of manifolds extending proximate to a bottom wall region of the liner assembly. Preferably, each of the plurality of manifolds is coupled to the front wall region. Furthermore, each of the plurality of manifolds is substantially parallel. Moreover, each of the at least two manifolds extend proximate to the bottom wall region of the liner assembly include a plurality of passageways spaced about the length thereof, the passageways of one of the at least two manifolds being offset relative to the other of the plurality of passageways.

In one preferred embodiment, the at least one manifold is substantially flexible. In this embodiment the manifold comprises one or more flexible tubes, preferably branched, wherein the passageways are positioned at discrete intervals along the length of and optionally at the end of each branch.

In another preferred embodiment the at least one manifold forms at least one ring proximate to a wall region of the liner assembly. Preferably there is a plurality of manifolds, each forming a ring proximate to separate wall regions of the liner assembly, each including a plurality of passageways spaced about the length thereof. The passageways of one manifold are offset relative to the passageways of the other manifolds.

Preferably the at least one passageway includes at least one nozzle. Preferably there is a plurality of nozzles, such that there is at least one nozzle included in a plurality of the passageways. Each nozzle can accept an input pressure of from about 3 psig ($20.7\times10^3$ Pa) to about 100 psig ($698.5\times10^3$ Pa). Preferably the pressure is substantially equal for all nozzles during filling and evacuation of the flexible bulk container.

Preferably the at least one manifold is oriented within the flexible bulk container such that the passageways are strategically positioned along at least one of the front, back, top, bottom and side walls of the flexible bulk container. The orientation is such that delivery of the second material through the passageways impinges upon the first material in a manner which achieves maximum contact with the first material.

In another preferred embodiment of the present invention attached to the surface of the flexible bulk container are optional securement sleeves to help physically support and protect the material delivery system. Such securement sleeves preferably comprise the same composition as the liner assembly itself, but can be of any suitable composition. Thus, they are preferably polyester weave having a polyvinylchloride coating. Typically the securement sleeves will be of multiple layers of the coated polymer, which comprises the liner assembly, and are attached to the interior surface of the liner assembly by adhesives, radio frequency welding techniques, or other methods.

In yet another preferred embodiment, the bulk transport system further comprises a liner and container attachment assembly. The liner and container attachment assembly facilitate attachment of a portion of the liner assembly with a portion of the container assembly. In one such embodiment, the liner and container attachment assembly comprises a plurality of suspension members having a first end attached to the liner assembly and a second end attached to the container assembly. In one preferred embodiment, the liner and container attachment assembly comprise a plurality of tension bars. The tension bars are attached to both the liner assembly and the container assembly. The tension bars are typically comprised of metal or other suitable composition. Alternatively cables or straps of webbing or of any suitable composition can be employed as the attachment assembly to stabilize the liner assembly within the container assembly. The number and strength of the container attachment assemblies employed is based upon the size and weight of the filled liner assembly. Optionally the container attachment assembly can have any suitable fastener, such as buckles or other mechanisms, useful in anchoring the liner assembly to the container assembly.

The invention further comprises a flexible bulk container, described above as the liner assembly component of the bulk transport system, capable of transporting a first material and introducing a second material for mixing therewithin, comprising (a) a body defining a cavity; (b) at least one opening and at least one vent, each providing communication with the cavity; and (c) a material delivery system assembly having at least one manifold, a portion of which is positioned within the cavity, the at least one manifold having a shell, an interior region and an inlet accessible from outside of the cavity and at least one passageway extending from the internal region, through the shell, to, in turn, place the interior of the manifold in communication with the cavity. Details of the flexible bulk container and the liner assembly are the same and are as described above.

The present invention further comprises a process for dissolving, reducing the density, or reducing the viscosity of a first material comprising the steps of (a) filling with a first material a flexible bulk container comprising a body defining a cavity; at least one opening and at least one vent, each providing communication with the cavity; and a material delivery system assembly having at least one manifold, a portion of which is positioned within the cavity of the flexible bulk container, the at least one manifold having a shell, an interior region and an inlet accessible from outside of the cavity of the flexible bulk container and at least one passageway extending from the internal region, through the shell, to, in turn, place the interior of the manifold in communication with the cavity;

(b) supplying the cavity with a second material through the material delivery system assembly;

(c) dissolving, reducing in density, or reducing in viscosity the first material by contacting with the second material to form a resulting material;

(d) venting air and gas through the vent of the flexible bulk container; and (e) evacuating the resulting material through the at least one opening of the flexible bulk container.

The process first involves filling the above-described flexible bulk container with a first material through the at least one opening comprising an inlet. This first material is usually a solid or viscous material. It can be in any suitable form, such as powdered, particulate, granular, briquettes, paste, emulsion, dispersion, slurry, or solid. A second material, preferably a liquid capable of dissolving, liquefying, reducing the density, or reducing the viscosity of the first material, is then fed through an inlet to the material delivery system assembly and into the cavity of the flexible bulk container. The second material contacts the first material. The material resulting after the first material is dissolved, liquefied, reduced in density, or reduced in viscosity is simultaneously withdrawn from the flexible bulk container via the at least one opening comprising an outlet and is transferred to a separate discreet rigid container (mixing tank) or to other containers. During this operation air and gasses are vented from the flexible bulk container through the vent opening. The supplying and evacuating of material from the flexible bulk container can be done employing two pumps, one connected to an inlet conduit and one to an outlet conduit. The supplying and evacuating can also be accomplished by using a pressurized source to supply the second material through the inlet and material delivery system assembly to contact the first material, and using a pump to withdraw the material resulting after contacting and send it through the outlet.

Another preferred embodiment of this process further comprises recirculating a portion of the evacuated material back into the flexible bulk container to aid in dissolving the first material. In this embodiment the cavity is supplied with the second material through the material delivery system assembly and can be directly fed into the material delivery system assembly via the at least one opening comprising an inlet, or fed through a mixing tank and then into the material delivery system assembly via the at least one opening comprising an inlet. The second material contacts the first material to form a resulting material, and the resulting material is evacuated through the at least one opening of the flexible bulk container comprising an outlet, and at least a portion of it is returned to the mixing tank. The steps of supplying, dissolving or reducing, evacuating and returning are repeated until a desired concentration of first material is dissolved, reduced in density, or reduced in viscosity. In operation the second material is transferred, preferably via a first pump, through an inlet conduit or mixing tank, to and the material delivery system assembly and into the flexible bulk container. The second material contacts the first material within the flexible bulk container thereby dissolving, liquefying, reducing the density, or reducing the viscosity of the first material to yield a resulting material. The resulting material is evacuated from the flexible bulk container, preferably via a second pump, through an outlet conduit to the mixing tank. The recirculation can be achieved by any suitable configuration of connecting conduits. The pressure within the flexible container is controlled by the interaction of the first and second pumps, and venting of air and gasses from the cavity. The pressure within the flexible bulk container can also be controlled by the interaction of the pressurized source of the second material and the pump that is evacuating the resulting material from the flexible bulk container, combined with venting air or gasses from the cavity. The second material entering through the material delivery system assembly impinges upon the first material within the cavity of the flexible bulk container to dissolve it, reduce its density, or reduce its viscosity. The impingement is controlled at a pressure and flow rate that decrease the time required to dissolve, liquefy, reduce the density, or reduce the viscosity of the first material. The pressure and flow rate are controlled by simultaneous operation of both pumps with venting, or by the use of the evacuation pump in conjunction with the pressurized source of the second material with venting. The vented air and gasses can be directed into the mixing tank, into a treatment system such as a gas/particle recovery system or a scrubber apparatus, or into the atmosphere, as appropriate to protect operating personnel and the environment.

The invention further comprises a method of transporting bulk materials. The method comprises the steps of: (a) providing a container assembly; (b) providing a liner assembly, the liner assembly comprising: a body defining a cavity; at least one opening and at least one vent, each providing communication with the cavity; and a material delivery system assembly having: at least one manifold, a portion of which is positioned within the cavity of the liner assembly, the at least one manifold having a shell, an interior region and an inlet accessible from outside of the cavity of the liner and at least one passageway extending from the internal region, through the shell, to, in turn, place the interior of the manifold in communication with the cavity; (c) positioning the liner assembly within the container assembly at a first geographical location; (d) filling the cavity of the liner assembly with a first material through the at least one opening and sealing the liner assembly; (e) transporting the container assembly and liner assembly to a second geographical location; (f) supplying the cavity with a second material through the material delivery system assembly; (g) dissolving, reducing in density, or reducing in viscosity the first material by contacting with the second material to form a resulting material; (h) venting air and gas through the vent of the liner assembly; and (i) evacuating the resulting material through the at least one opening of the liner assembly. In another preferred embodiment this method further comprises (j) removing the liner assembly from the container assembly. In another preferred embodiment this method further comprises (k) returning the liner assembly to the first geographical location or transporting the liner assembly to a third geographical location for reuse.

In a preferred embodiment of this method at a first geographical location the liner assembly of the bulk transport system is positioned within the container assembly and filled with a first material to be transported. The first material is added through the material delivery system assembly, or more typically, through the at least one opening comprising an inlet. The opening is then sealed with a fitment or cover. The filled bulk transport system is then transported to the desired second geographical location (destination). This is usually by car, truck, train, ship, plane, or any other suitable vehicle of transport. During transporting, the liner assembly is preferably stabilized within the container assembly by use of the liner and container attachment assembly as previously described. If desired multiple liner assemblies can be transported within a single container assembly. At the second geographical location, the first material within the liner assembly is dissolved, liquefied, reduced in density, or reduced in viscosity as described above by contacting with the second material. The resulting material is then partially or totally discharged from the liner assembly as described above. After the liner assembly is emptied, the liner assembly is then removed from the container assembly and can be reused. In another preferred embodiment of this method the liner assembly is returned to the first geographical location for reuse. Alternatively the liner assembly can be transported to a third geographical location for reuse, or reused at the second geographical location.

In another such embodiment, the method further comprises the steps of folding the liner assembly. In one such embodiment, the method includes the step of placing the folded liner assembly onto a pallet for transport to the first or alternate geographical location.

The bulk transport system, bulk flexible container, process, and method of the present invention are useful for shipping solid or viscous materials to a remote site for dissolution, reduction in density, or reduction in viscosity at that site prior to withdrawal from the container in which the material is shipped. The invention has applicability to a wide variety of materials and industries. Included for example are agricultural, fire fighting, food, pharmaceutical, chemical, energy, biological, safety, cleaning and other materials. By dissolving or diluting materials after shipment, the costs and inconveniences of shipping heavy liquids is avoided. The invention is particularly suitable for shipping of hazardous materials, for example, sodium cyanide, since a more stable solid or viscous form can be transported and converted into a liquid after arrival at its destination. In a particularly preferred embodiment of the present invention, the first material comprises sodium cyanide.

Referring now to the drawings and in particular to FIG. 1, bulk transport system 10 is shown as comprising container assembly 12, liner assembly 14 and liner and container attachment assembly 16. It will be understood that the bulk transport system 10 is preferably contemplated for use in association with sodium cyanide, and the eventual solution thereof in water. Of course, the invention is not limited thereto, and can be used in association with the shipment and dissolution, reduction of density, or reduction of viscosity of a number of different materials into a number of fluids (i.e., fluids of various compositions, densities and viscosities) as discussed above.

Figure 2:
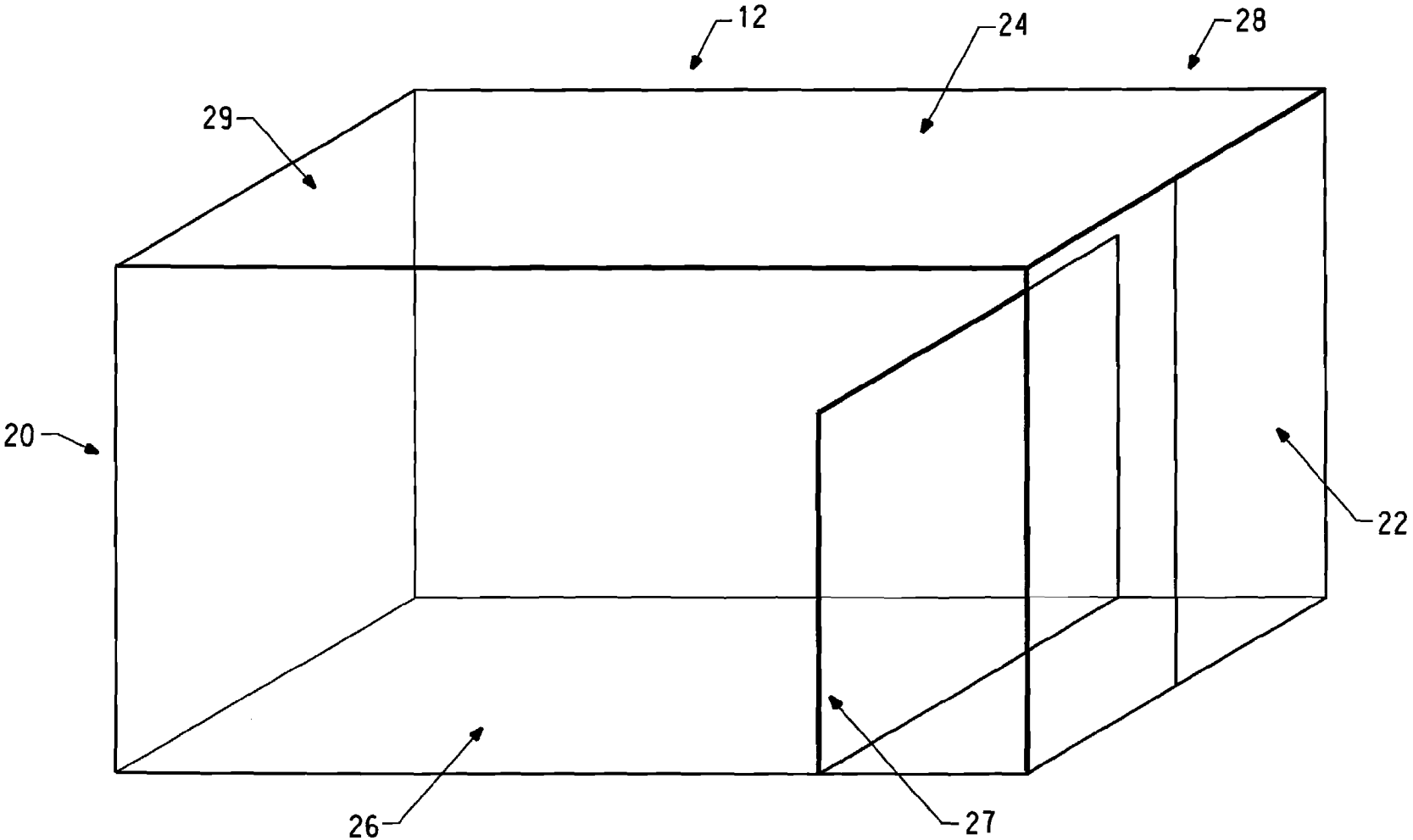
FIG. 2 of the drawings is a perspective view of the container assembly of the present invention.

Container assembly 12 is shown in FIG. 2 as comprising front wall 20, back wall 22, top wall 24, bottom wall 26 and opposing side walls 28, 29. One common type of container assembly comprises a conventional twenty (20) foot or forty (40) foot shipping container. With such containers, back wall 22 generally includes a pair of doors, which hinge about an outer edge thereof. Of course, other containers are contemplated for use, including both other standard and non-standard shipping containers.

As is shown in FIG. 2, it is further contemplated that the container assembly 12 may include bulkhead 27 positioned proximate to one of the front and back walls. In the embodiment shown, bulkhead 27 is substantially parallel to the front and back walls and spaced apart a relatively short predetermined distance from the back wall. The bulkhead may extend from one sidewall to the other sidewall and from the top wall to the bottom wall. In other embodiments, the bulkhead may have dimensions smaller than the front or back wall such that while the bulkhead may extend from one sidewall to the other sidewall, but the bulkhead does not extend from the top wall to the bottom wall. Furthermore, it is contemplated that the bulkhead may be permanently or releasably attached to the walls of the container assembly. Of course, with certain embodiments, a bulkhead may be fully eliminated.

Figure 3:
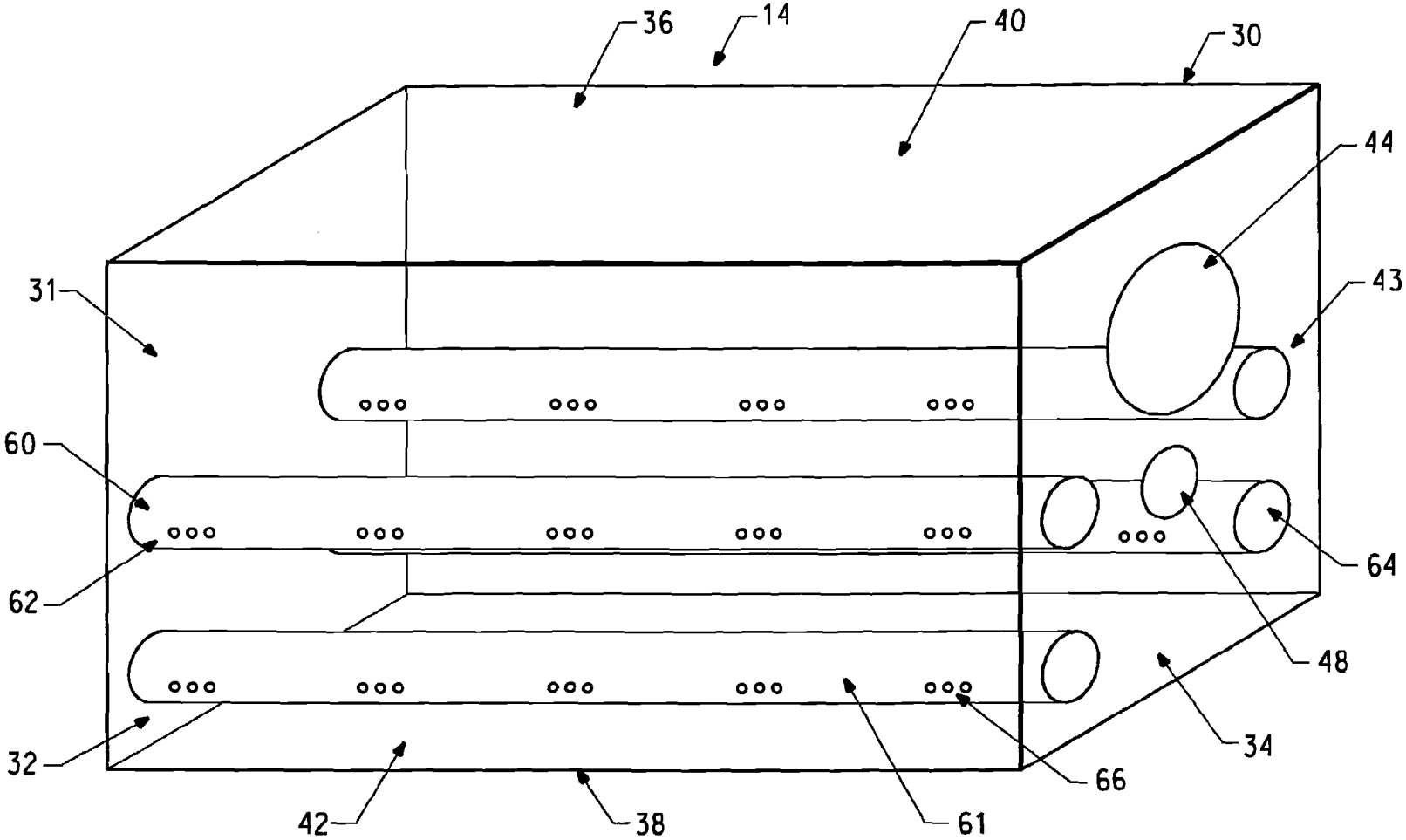
FIG. 3 of the drawings is a perspective view of one embodiment of the liner assembly of the present invention.

Liner assembly 14 is shown in FIG. 3 as comprising body 30, at least one opening, such as opening 44, and material delivery system assembly 43. Body 30 defines cavity 31 and opening 44 provides communication thereto. Body 30 comprises a flexible polymer and/or composite material, which may include a number of different layers of laminate, and/or plies of laminate. One such material comprises a polyvinylchloride coated polyester weave base cloth, which is collapsible and foldable. One such material is available from Verseidag AG, Krefeld, Germany. Body 30 is of a shape which generally corresponds to the dimensions of container assembly 12, and includes front wall region 32, back wall region 34, top wall region 36, bottom wall region 38 and side wall regions 40, 42. It is contemplated that each of the wall regions comprise a separate panel of material which is attached to other panels by way of any number of attachment means, including, but not limited to heat sealing, RF welding, adhesive, stitching, mechanical attachment, among others. In other embodiments, any number of panels can be formed from a unitary panel of material, which is cut and formed into the desired shape.

In the embodiment shown, the liner assembly is positioned between front wall 20 and bulkhead 27. The liner assembly extends substantially between the sidewalls and substantially between the bottom wall and the top wall. In other embodiments, the liner assembly may have a height which is less than the height of the sidewalls, or a width less than that of the front and back walls, or a length less than the length of the sidewalls.

Figure 4:
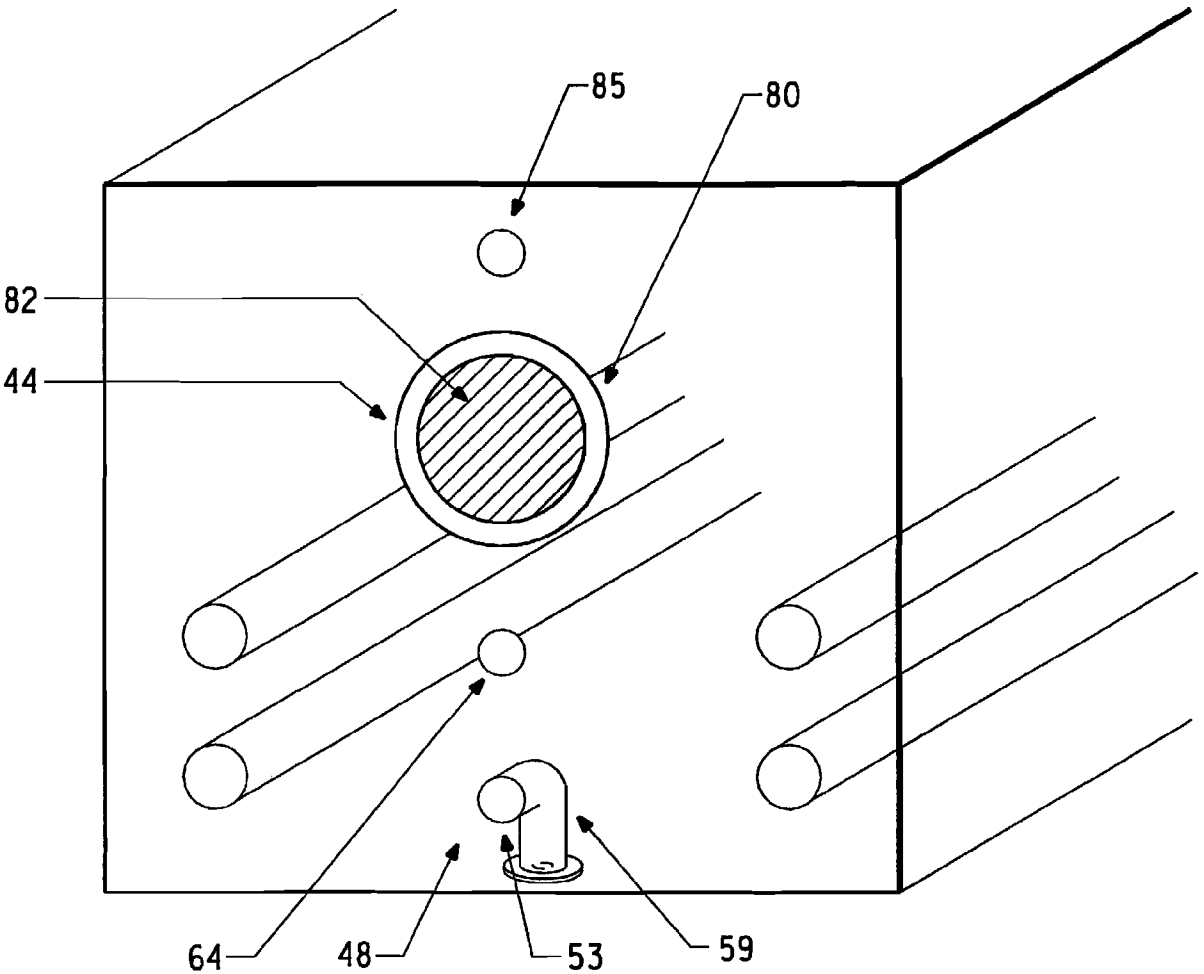
FIG. 4 of the drawings is a partial front perspective view of the back wall region of one embodiment of the liner assembly of the present invention.

Openings are shown in FIGS. 1 and 3 as comprising inlet opening 44 and outlet 48. Inlet opening 44 comprises an opening configured for the ingress of dry or viscous material (generally solids) into the container. As is shown in FIG. 4, opening 44 includes fitment 80 and cap 82. In one embodiment, fitment 80 is attached to the liner assembly through any number of different structures, including but not limited to heat sealing, RF welding, adhesion, mechanical fastening, and the like. Cap 82 can be cooperatively attached to fitment 80 so as to provide a substantially fluid tight seal to opening 44. Cap 82 may include a threadform, which cooperates with a mating threadform on fitment 80. In another embodiment, cap 82 may comprise a plate which is fastened (i.e., bolted) to fitment 80.

While any number of different dimensions is contemplated for use, it is contemplated that opening 44 has a diameter of between 15 and 18 inches (38.1 to 45.7 cm). Moreover, while a number of different positions for the inlet are contemplated (i.e., on any of the wall regions), the inlet is preferably located on the back wall region in a position wherein it may be accessible through and around bulkhead 27 or otherwise accessible proximate to back wall 22 of the container assembly. It is contemplated that a plurality of inlets may be provided on the same wall region, or on different wall regions to increase the rate at which the liner assembly cavity can be filled.

As is shown in FIG. 4, outlet 48 comprises an opening which facilitates the removal of the material resulting from contacting the first and second materials, preferably in fluid form, from within liner 14 (i.e., after the first material is dissolved, reduced in density, or reduced in viscosity by contacting with the second material). The outlet includes valve 53 which can selectively preclude and/or facilitate passage of the resulting material through the outlet. It is contemplated that the outlet comprise a dimension of approximately 2 to 3 inches (5.1 to 7.6 cm). Of course, other dimensions are likewise contemplated. Preferably, the outlet is positioned on the back wall region below the inlet, proximate to the bottom wall region. In such a configuration, the outlet may include an internal suction device 59, which interfaces with the bottom wall region to facilitate full evacuation of the liner assembly. The suction device may also have a filter or perforated suction plate that keeps large solid particles from entering the outlet and plugging conduits, pumps or other equipment. Of course, other positions for the inlet are likewise contemplated, as are any number of different sizes and shapes for the outlet. It is further contemplated that a number of outlets may be provided to increase the rate at which the liner assembly cavity can be evacuated. Furthermore, the inlet and the outlet may comprise a single opening which is utilized to both introduce material into the container, and to evacuate the container.

Material delivery system assembly 43 is shown in FIGS. 1 and 3 as comprising at least one manifold, such as manifold 60. While four manifolds are shown in FIG. 3, manifold 60 will be described with the understanding that the remaining manifolds have similar structural features. Indeed, any number of manifolds of varying configuration, dimension, shape and orientation are contemplated. The various manifolds may be identical in shape and configuration, or may have variations therein. Moreover, the manifolds may be positioned in any number of positions and orientations. It is contemplated that the manifolds comprise a material that may be collapsed and folded with the flexible bulk container.

Figure 5:
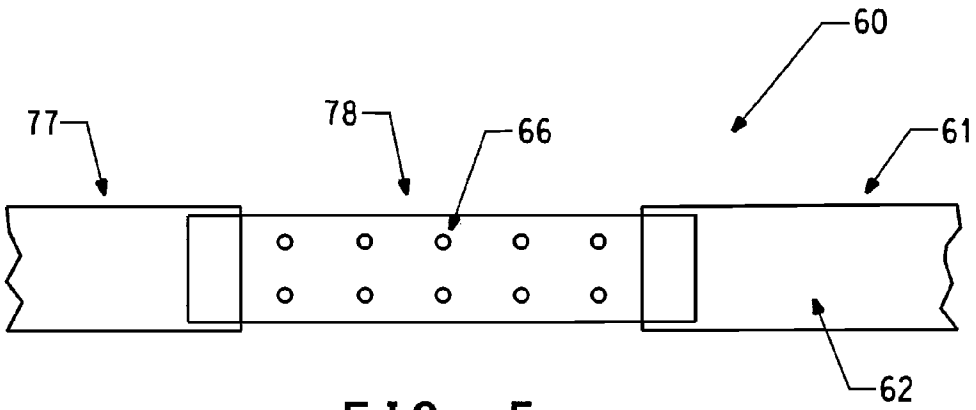
FIG. 5 of the drawings is a partial side elevational view of a portion of the at least one manifold of the present invention.

In more detail, manifold 60 is shown in FIG. 3 as comprising outer shell 61, internal region 62, at least one inlet, such as inlet 64, and at least one passageway, such as passageway 66. The outer shell extends from back wall region 34 to front wall region 32, and the outer shell is substantially uniformly circular, having an approximately 1 inch (2.5 cm) diameter, and may comprise a substantially flexible material, such as a polymer based hose. In one embodiment, as is shown in detail in FIG. 5, the manifold may comprise flexible hose 77 having insert members, such as insert member 78 positioned therealong. In such an embodiment, the passageways 66 may be disposed upon the rigid inserts. In such a manner, the manifold may be substantially flexible and collapsible, while the passageways may be positioned in a material of increased rigidity so as to maintain the integrity and the conformity of the passageways. For example, the insert members may comprise a plastic material.

Figure 6:
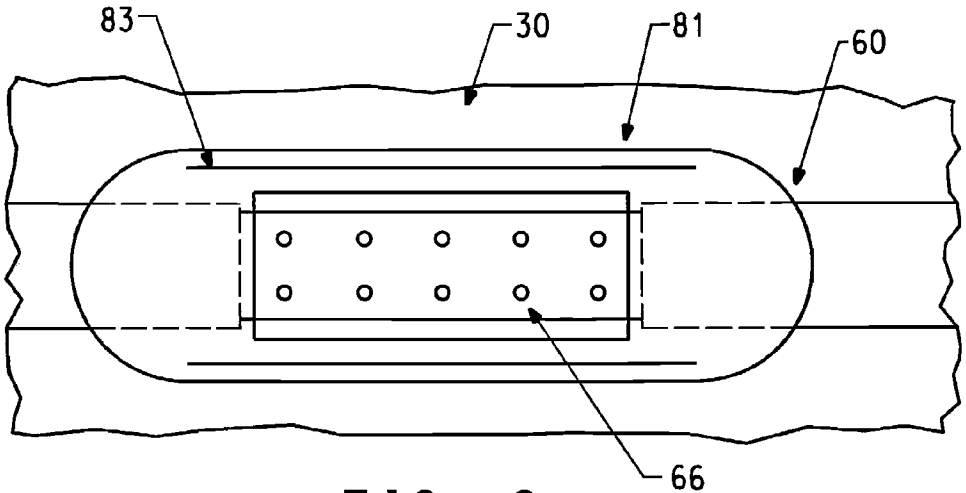
FIG. 6 of the drawings is a partial top plan view of a portion of the at least one manifold of the present invention, showing in particular, the attachment thereof to the liner assembly.

The outer shell is coupled to each of the front and back wall regions so as to be substantially perpendicular to each of the wall regions when the container is in the articulated form. In one embodiment, securement sleeves 81 (FIG. 6) may be attached on any of the wall regions of body 30 at securement regions 83. As will be understood, the manifold can be positioned between the sleeve 81 and the respective wall region. Inlet 64 is attached to back wall region 34 and is associated with outer shell 61 to provide fluid communication with internal region 62 of manifold 60. Inlet 64 may include a fixed or removable coupling which is capable of accepting any number of conventional or specialized fittings. Such fittings may include couplings having valves, quick-connect fittings or threaded fittings. A cover may be provided over inlet 64 when the manifold is not in use. Again, the manifolds are not limited to such a configuration or orientation.

While not limited thereto, one embodiment includes at least one manifold extending from the front wall region to the back wall region along the bottom wall region. To facilitate placement of the manifold along the bottom wall region, the manifold may be secured to the bottom wall region in any number of different manners. Such a manifold position provides effective flow of the second material, preferably a fluid, and, in turn, dissolution, reduction of density, or reduction of viscosity of the first material within the container. Other configurations along the bottom wall region are likewise contemplated.

Passageway 66 extends through outer shell 61 of manifold 60 to provide fluid communication between internal region 62 of manifold 60 and cavity 31 of liner assembly 14. As is shown in FIG. 3, a plurality of passageways, such as passageway 66 are dispersed about the manifold at strategic locations. The passageways generally have a cross-sectional area less than that of the manifold surrounding the passageway. The precise shape and cross-sectional area of the passageways along with the position thereof can be determined experimentally for any number of different materials and solutions that may be carried within the bulk transport system. It will be understood that by varying the dimension and the number of the passageways, flow rates of the second material through the manifold and into the cavity can be controlled, as can the velocity and pressure of the exiting material.

Furthermore, the flow throughout the cavity can be controlled by the positioning of the passageways along the manifold to achieve proper distribution of the second material in all regions of the cavity. In turn, substantially all of the material within the liner assembly can be reduced in viscosity, reduced in density, or dissolved in solution, and, un-dissolved regions of solid material, or partially dissolved clumps of material can be avoided. Furthermore, the respective position of the passageways of various manifolds and the shape and orientation can be used to control the flow paths of the second material introduced through the manifolds.

In the preferred embodiment, liner assembly 14 includes vent 85 (FIG. 1). Vent 85 provides a means by which to vent cavity 31, to maintain the pressure within cavity 31 within a desired and acceptable range. In certain embodiments, vent 85 may be coupled to a gas/particle recovery system (to recover any material that is expelled through vent 85). In other systems, vent 85 may include a valve as a means by which to control flow therethrough.

Liner and container attachment assembly 16 is shown in FIG. 1 as facilitating attachment of the liner assembly to various portions of the container assembly. One container attachment assembly may comprise a plurality of suspension members 52 configured to attach to discrete portions of the container at a first end and to discrete portions of the liner assembly at a second end. In the embodiment shown, a plurality of suspension members 52 extend between the top wall region 36 and the top wall 24 of container assembly 12. In other embodiments, any one of the wall regions of the liner assembly can be attached by way of the suspension members to any one or more of the side walls, the front wall, the back wall, the bulkhead and the top wall. The suspension members may comprise a cable or strap attached at one end to the container assembly and to the other end to the liner assembly. The assembly can comprise an adjustable strap that can be used to raise a portion of the body of the flexible bulk container to direct material toward the at least one opening comprising an outlet.

In operation, liner assembly 14 is inserted into container assembly 12. The liner assembly can be attached to the container assembly by way of liner and container attachment assembly 16. The type of attachment assembly that is utilized will vary depending on the relative size of the liner assembly and the container assembly, as well as the manner in which the container may be filled. In certain embodiments, it may be unnecessary to utilize any container attachment assembly.

Figure 7:
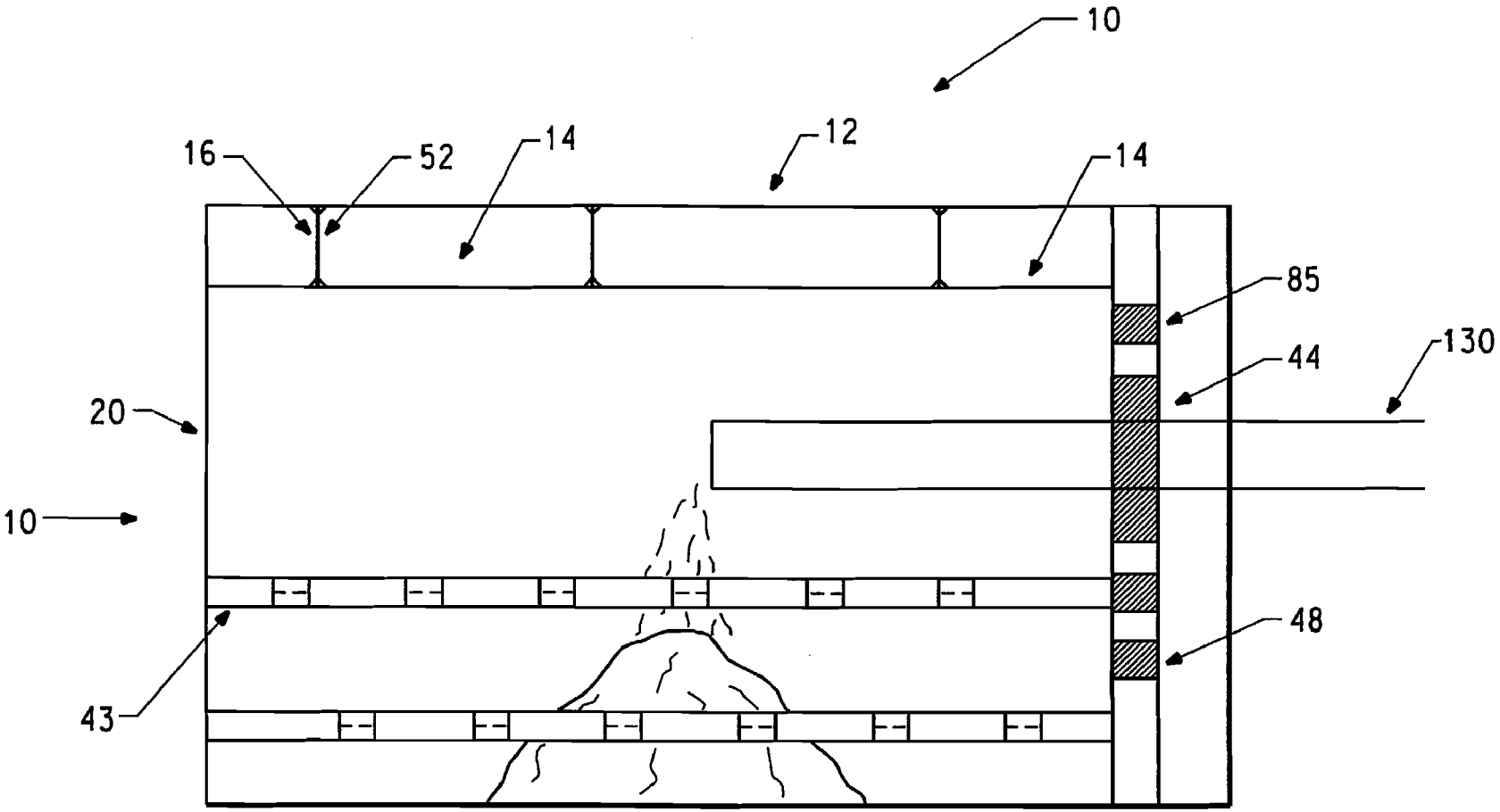
FIG. 7 of the drawings is a side elevational view of the system in one process of filling thereof.

Next, the cavity of the liner assembly is filled with a first material (i.e., a solid material, such as sodium cyanide). In one filling process, shown in FIG. 7, a product fill line 130 can be introduced into opening 44 so as to dispense product away from each of the front and back walls (i.e., toward the middle thereof). In such a process, suspension members 52 may be employed so as to suspend the top wall region from the top wall of the container assembly. Moreover, depending on the configuration of the product fill line, the product fill line itself can be utilized to raise or separate the top wall region from the bottom wall region.

Figure 8:
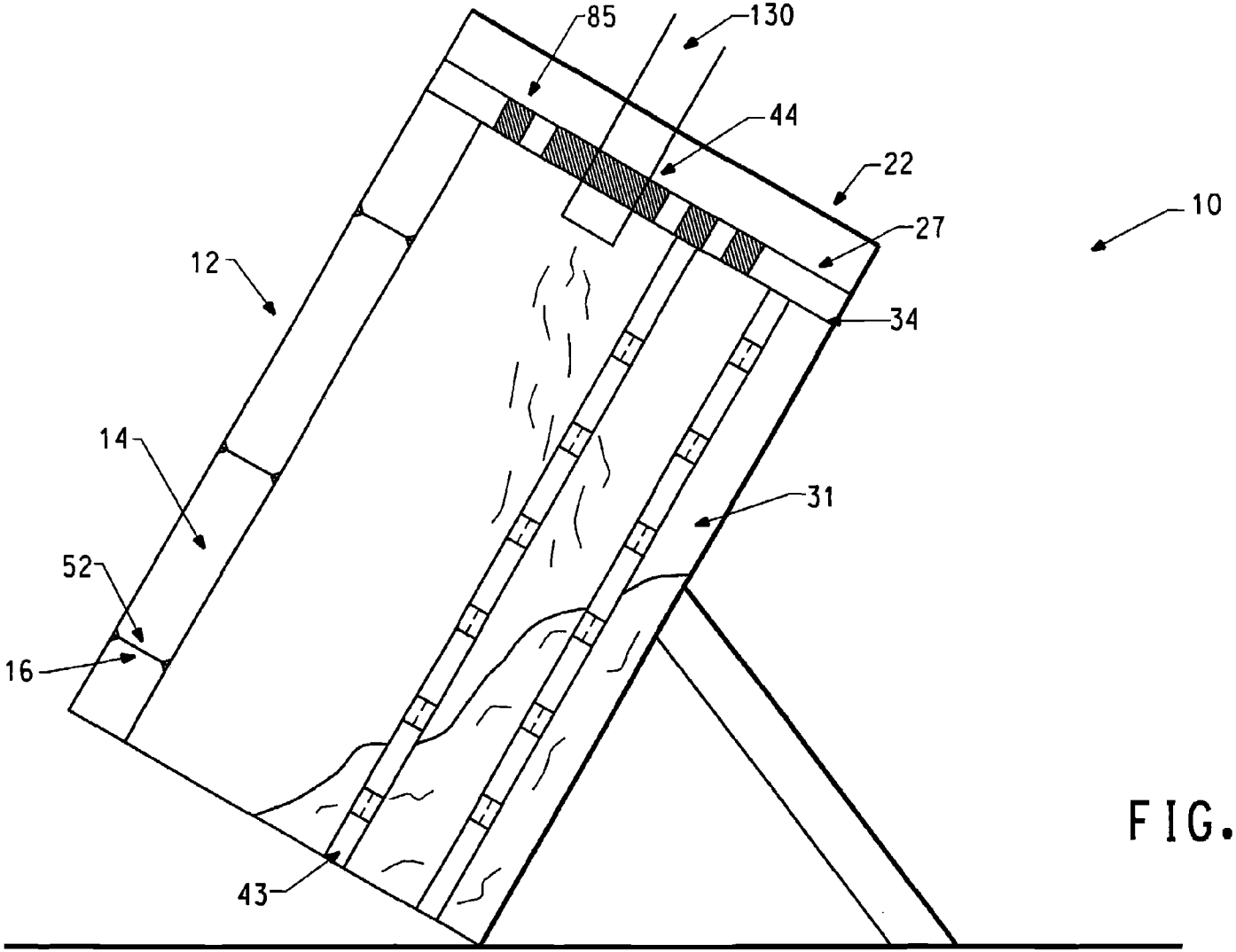
FIG. 8 of the drawings is a side elevational view of the system in another process of filling thereof.

In another example, shown in FIG. 8, the container assembly and the liner assembly can be tilted or inclined at an angle so as to rotatably raise the rear wall from the ground. In such an embodiment, suspension members 52 can be utilized to couple and associate back wall region 34 of the liner assembly with back wall 22 (or with bulkhead 27) of container assembly 12, placing opening 44 in an accessible location. The product fill line is then positioned over the inlet (or within cavity 31), over a fill chute, or sealed in opening 44 by various means to dispense product through the force of gravity. Of course, other methods of filling the liner assembly are contemplated for use.

Once the liner assembly is filled as a desired, the product fill line is repositioned away from opening 44. Opening 44 is then sealed to effectively provide a substantially fluid tight seal. Once sealed, the outer container can be stored and/or shipped by any number of different shipping methods along with other shipping containers. As with other bulk transport systems, shipment can be made by truck, rail, air and/or sea.

Figure 9:
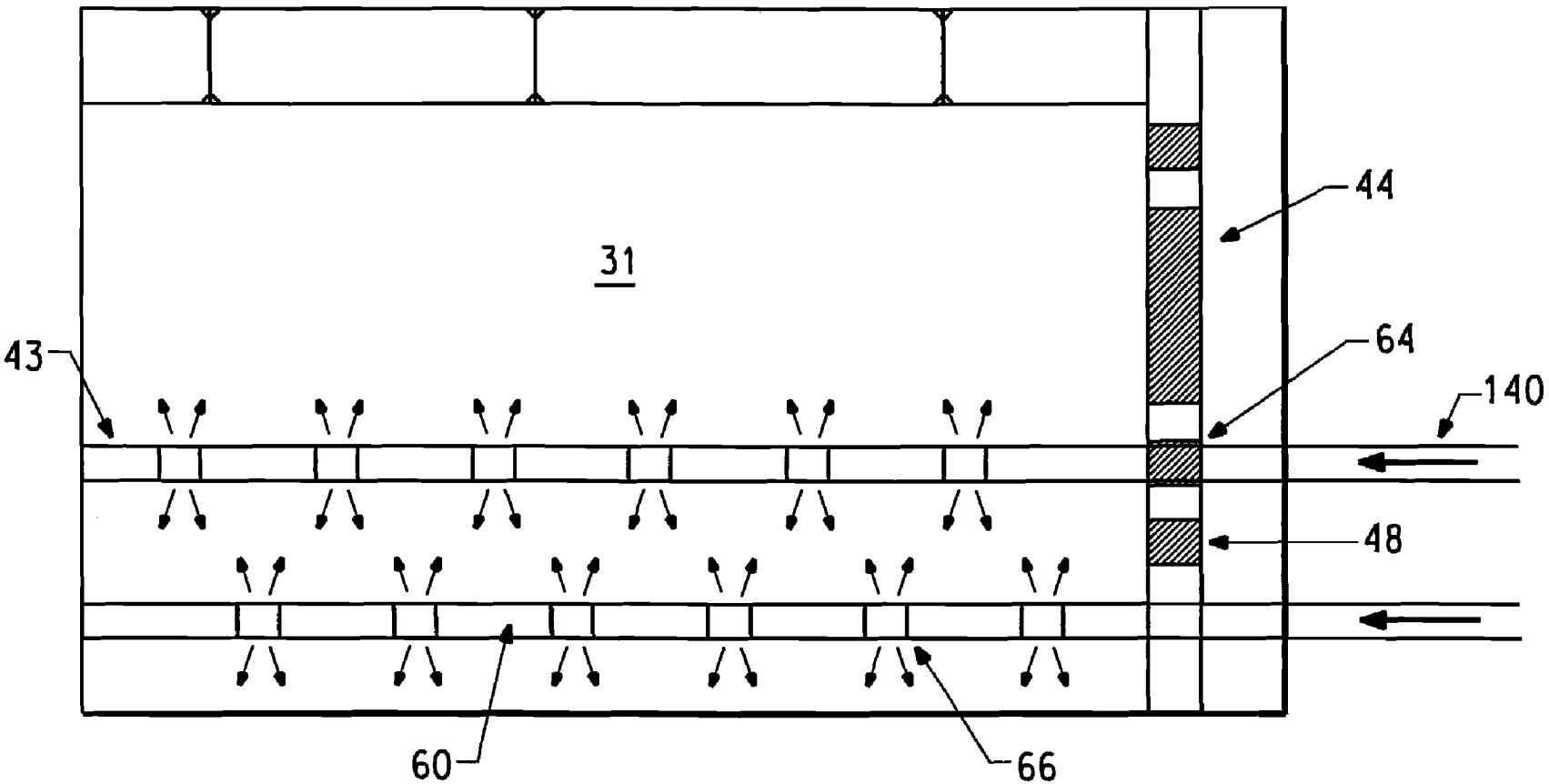
FIG. 9 of the drawings is a side elevational view of one embodiment of the system in the process of introducing a second material through the material delivery system assembly.
Figure 10:
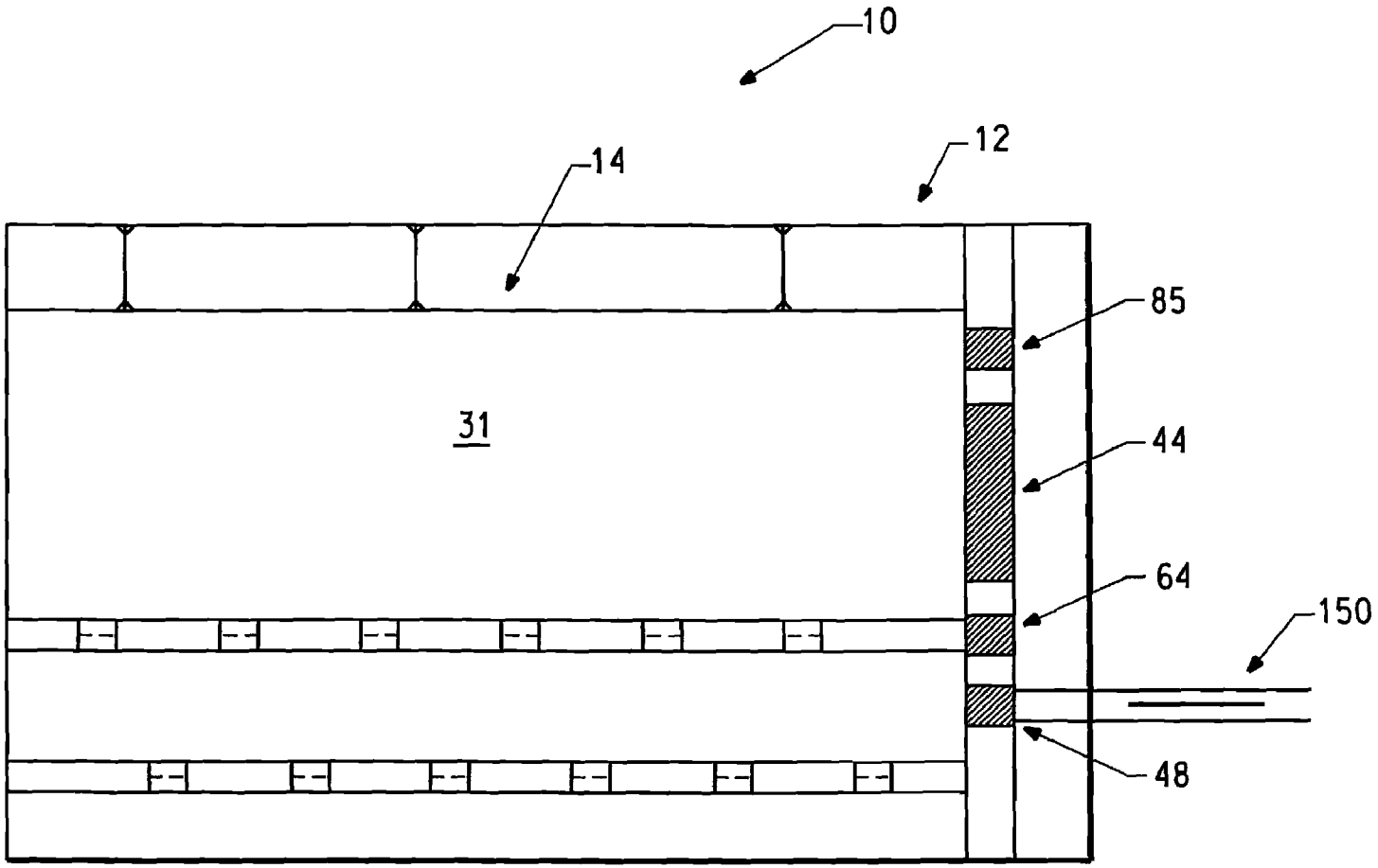
FIG. 10 of the drawings is a side elevational view of one embodiment of the system in the process of discharging a material through the outlet of the liner assembly.

Once the liner assembly reaches an end user's destination (such as, for example, the use of sodium cyanide at mines around the world), a solution, reduced density material or reduced viscosity material can be prepared within the liner assembly, without requiring removing of the first material from the liner assembly. Specifically, and as is shown in FIG. 9, second material supplies 140 (i.e., water lines) are coupled to the inlets 64 of the manifolds of the material delivery system assembly. Through valves, the second material is provided from the second material supplies through inlet 64 and into the manifolds. The second material passes through the manifolds and eventually through the passageways 66 into cavity 31. As the second material is directed into cavity 31, the first material is reduced in viscosity, reduced in density, or dissolved into solution. Due to the positioning of the passageways and the relative size and shape of the passageways, an effective agitation is provided by the force of the incoming second material to effectively reduce in viscosity, reduce in density, or dissolve the first material without outside agitation. Once reduced in viscosity, reduced in density, or dissolved, the resulting material may be maintained within the liner assembly until required. Referring now to FIG. 10, when the resulting material is needed, a hose or other apparatus 150 can be coupled to outlet 48 so that the resulting material can be evacuated from the container.

Figure 11:
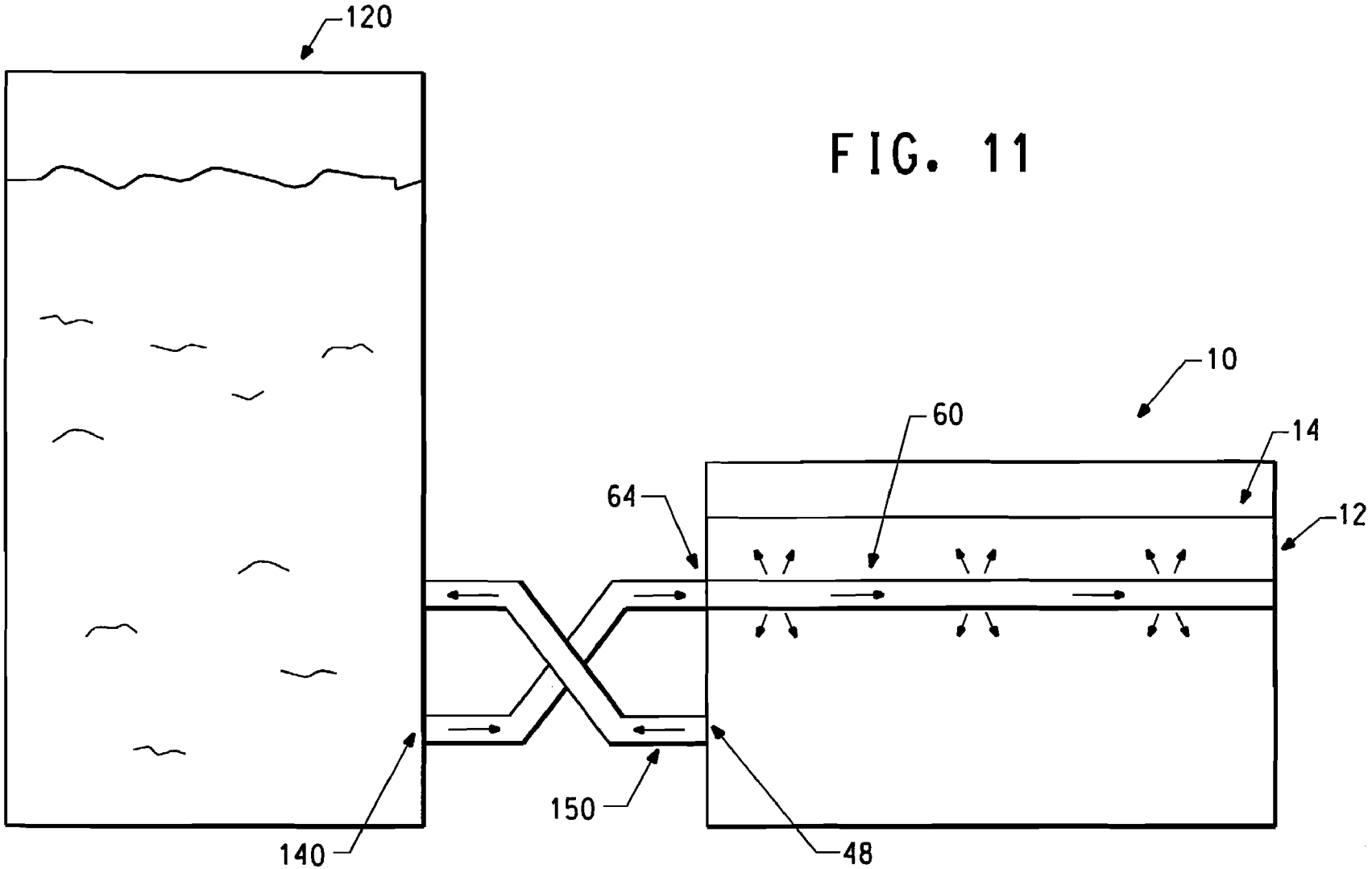
FIG. 11 of the drawings is a schematic representation of one embodiment of a method of dissolving the first material into a fluid, reducing the density of the first material, or reducing the viscosity of the first material.

As is shown in the embodiment of FIG. 11, in certain situations, the concentration of the second material is such that the first material is dissolved in a quantity of fluid generally in excess of the capacity of the liner assembly. In such an embodiment or process, the material resulting from contacting the second material with the first material can be circulated between the liner assembly 14 and a separate holding/mixing tank 120, which is capable of holding a required capacity. In particular, the resulting material after contacting can be directed repeatedly, from the holding/mixing tank, through inlet 64 and the manifolds 60 of the material delivery system assembly, through the outlet 48 of the liner assembly, into the mixing tank 120. This recirculation process can continue until the first material is reduced to the desired viscosity, reduced to the desired density, or fully dissolved, or until a desired concentration of the resulting material is reached. Once complete, the resulting material, preferably in solution form, can be maintained within the holding/mixing tank until needed or moved to other storage tanks until needed.

Once the container is fully drained of the resulting material, the material delivery system assembly can be utilized to clean/wash the liner assembly. Subsequently, the inlet and the outlet of the liner assembly can be sealed, along with the inlet to the manifolds, and, the liner assembly can be collapsed and folded into a size that is suitable for shipment on, for example, pallets. The container assembly can be utilized for different purposes, or a number of folded liner assemblies can be placed within a single container assembly for return and reuse. Advantageously, as the container assembly is preferably a standard shipping container, and not a container configured for specific use, such a container can be returned locally.

EXAMPLES

Example 1

A flexible bulk container was constructed in the shape of a bag with a capacity of 847 cubic feet (24 $m^3$). The dimensions were 5.5 m long by 2.33 m wide by 2 m high. The top length was 4.8 m sloping towards the front. The fabric employed was polyester 3×3 panama weave having the following properties and the properties were tested by the DIN methods indicated: base cloth weight of 630 g/$m^2$ (DIN 60001), tensile strength of 9900N/50 mm warp (DIN 53354) and 8400N/50 mm weft (DIN 53354), tear strength of 1500N (DIN 53356 and DIN 53357), and adhesive strength of 150N/50 mm (DIN 53358). The polyester contained ultraviolet and fungicide inhibitors. The polyester was coated with polyvinylchloride at 1020 g/m2 (DIN 53854). The overall weight of the container was 153 kg. The container had four openings, 1) a 3 inch (7.6 cm) inlet fitted with a butterfly valve with quick release coupling for hose or tubing, 2) a 3 in (7.6 cm) outlet fitted with a butterfly valve with quick release coupling for hose or tubing, 3) a 16 inch (40.6 cm) opening fitted with a manhole cover, and 4) a 1 inch (2.54 cm) opening with stainless steel ball valve with quick release coupling for hose or tubing used for venting air or gas from the interior of the enclosure. Attached to the outer surface of the container were 12 side support adjustable straps and 8 front support adjustable straps. Fitted inside of the container and connected to the 3 inch (7.6 cm) inlet valve was a material delivery system assembly comprising a manifold spray system consisting of branched tubing in four-ring assemblies fitted with 40 DELRIN spray nozzles capable of accepting pressures up to 100 psi ($689.5\times10^3$ Pa).

Example 2

The flexible bulk bag of Example 1 was placed inside of a sea container having dimensions of 20 ft long (6.1 m) by 8 ft wide (2.4 m) by 8.5 ft (2.6 m) high. The bag was filled through the 16-inch (40.6 cm) opening with 44,080 lbs (20 metric tons) of sodium cyanide (NaCN) in the form of solid briquettes. The container was shipped from Memphis, Tenn. to Carlin, Nev. A source of water was connected via a first line through a first pump to the 3-inch (7.6 cm) inlet valve of the flexible bulk container. Water containing 0.4-weight percent sodium hydroxide was fed into the flexible container through the material delivery system assembly. A second line was connected from the 3-inch (7.6 cm) outlet valve through a second pump to a tank for mixing and storage. A vent line was connected to the vent valve. Water was pumped into the flexible bag through the manifold spray system to dissolve the NaCN while simultaneously pumping out the dissolved NaCN and venting the bag. The feed flow rate varied from 40 gallons (0.151 $m^3$) per minute to 207 gallons (0.783 $m^3$) per minute. The feed pressure varied from 3 psig ($20.7\times10^3$ Pa) to 30 psig ($206.8\times10^3$ Pa). Generally the bag level was maintained at half full of liquid and contents recirculated from the bag to the mixing tank to effect dissolution of the NaCN. The system worked effectively to dissolve NaCN and remove it as a solution from the flexible bag. After about one hour of operation, the system was changed to one wherein the water was fed from a pressurized tank and the first pump eliminated. The pressure and feed rate were controlled by the pressure of the pressurized tank and the pump was used for evacuation of the material. Generally the bag level was maintained at half full of liquid and contents recirculated from the bag to the mixing tank to effect dissolution of the NaCN. The system worked effectively to dissolve NaCN and remove it as a solution from the flexible bag. Based upon sample testing the bag was then totally evacuated into a storage tank. The dissolving process lasted four hours and eight minutes. The rate of NaCN in solution increased linearly up to about 3 hours and then remained level. The weight percent NaCN in solution obtained was about 22%.

Example 3

A flexible bulk container was constructed in the shape of a bag with a capacity of 1,000 cubic feet (28.3 $m^3$). The dimensions were 5.7 m long by 2.35 m wide by 2.25 m high. The top length was 5.0 m sloping towards the front. The fabric employed was polyester 3×3 panama weave having the following properties and the properties were tested by the DIN methods indicated: base cloth weight of 630 g/$m^2$ (DIN 60001), tensile strength of 9900N/50 mm warp (DIN 53354) and 8400N/50 mm weft (DIN 53354), tear strength of 1500N (DIN 53356 and DIN 53357), and adhesive strength of 150N/50 mm (DIN 53358). The polyester contained ultraviolet and fungicide inhibitors. The polyester was coated with polyvinylchloride at 1020 g/m2 (DIN 53854). The overall weight of the container was 254 kg (560 pounds). The container had four openings, 1) a 3 inch (7.6 cm) inlet fitted with a butterfly valve with quick release coupling for hose or tubing on the outside and connected to an internal manifold for distribution of the second material, 2) a 3 in (7.6 cm) outlet fitted with a butterfly valve with quick release coupling for hose or tubing on the outside and a perforated stainless steel suction strainer/filter on the inside, 3) a 16 inch (40.6 cm) opening fitted with a bolted manhole cover, and 4) a 3 inch (7.6 cm) outlet fitted with a butterfly valve with quick release coupling for hose or tubing used for venting air or gas from the interior of the enclosure. Attached to the outer surface of the container were 12, 2" side support adjustable straps and 8 front support adjustable straps. Fitted inside of the container and connected to the 3 inch (7.6 cm) inlet valve was a material delivery system assembly comprising a manifold spray system consisting of branched tubing in eight ring assemblies fitted with 42 DELRIN spray nozzles capable of accepting pressures up to 100 psi ($689.5\times10^3$ Pa). The container was also fitted with adjustable straps that can be used to raise the rear sidewalls to direct the resulting material to the suction manifold assembly on the outlet from the cavity.

Example 4

The flexible bulk bag of Example 3 was placed inside of a sea container having dimensions of 20 ft long (6.1 m) by 8 ft wide (2.4 m) by 8.5 ft (2.6 m) high. The bag was filled through the 16 inch (40.6 cm) opening with 44,094 lbs (20 metric tons) of sodium cyanide (NaCN) in the form of solid briquettes. The container was shipped from Memphis, Tenn. to Carlin, Nev. A source of water was connected via a first line from a pressurized container to the 3 inch (7.6 cm) inlet valve of the flexible bulk container. Water containing 0.5 weight percent sodium hydroxide was fed into the flexible container through the material delivery system assembly. A second line was connected from the 3 inch (7.6 cm) outlet valve through a second pump to a tank for mixing and storage. A vent line relieved air and gases to the atmosphere. Water from the pressurized container entered the flexible bag through the manifold spray system to dissolve the NaCN while simultaneously pumping out the dissolved NaCN and venting the bag. The feed flow rate varied from 140 gallons (0.530 $m^3$) per minute to 168 gallons (0.636 $m^3$) per minute. The feed pressure varied from 30 psig ($206.8\times10^3$ Pa) to 35 psig ($241.3\times10^3$ Pa). Generally the liquid level in the bag was maintained at 30 inches (76.2 cm), and the contents recirculated from the bag to the pressurized container to effect dissolution of the NaCN. The system worked effectively to dissolve NaCN and remove it as a solution from the flexible bag. The pressure and feed rate were controlled the pressure of the pressurized tank, and the pump was used for evacuation of the material. Based upon sample testing the bag was then totally evacuated into a storage tank. The dissolving process lasted six hours and 30 minutes. The rate of NaCN in solution increased linearly up to about 5.5 hours and then remained level. The weight percent NaCN in solution obtained was about 29.1%.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A process for dissolving, reducing the density, or reducing the viscosity of a first material comprising the steps of:

filling with a first material a reusable flexible bulk container which can be positioned within and removed from a second container, said flexible bulk container comprising:

a body defining a cavity;

at least one inlet for introducing said first material, at least one outlet, and at least one vent, each providing communication with the cavity; and a material delivery system assembly having:

at least one manifold, a portion of which is positioned within the cavity of the flexible bulk container, the at least one manifold having a shell, an interior region and an inlet accessible from outside of the cavity of the flexible bulk container and a plurality of passageways strategically positioned along the manifold extending from the internal region, through the shell, to, in turn, place the interior of the manifold in communication with the cavity, and wherein the at least one manifold is oriented within the flexible bulk container such that the outer shell of said manifold is coupled to each of a front and a back wall of the flexible bulk container, and the passageways are positioned along at least one of a side wall of the flexible bulk container;

supplying the cavity with a second liquid material through the material delivery system assembly;

dissolving, reducing in density, or reducing in viscosity the first material by contacting with the second material to form a resulting material;

venting air and gas through the vent of the flexible bulk container; and evacuating the resulting material through the at least one opening of the flexible bulk container.

2. The process of claim 1 wherein the passageway further comprises a nozzle.

3. The process of claim 1 wherein the supplying and evacuating of material to and from the cavity are controlled by at least one pump.

4. The process of claim 3 wherein a first pump controls the supplying of material into the cavity and a second pump controls the evacuating of material from the cavity.

5. The process of claim 1 wherein a pressurized container supplies the second material into the material delivery system at a rate that is controlled by the pressure in said pressurized container and a pump that evacuates material from the cavity.

6. The process of claim 1 wherein contacting of said second material with said first material is controlled at a pressure and flow rate that decrease time required to dissolve, liquefy, reduce the density, or reduce the viscosity of said first material.

7. The process of claim 6 wherein the pressure is maintained approximately the same for all nozzles during supplying and recirculating of the material.

8. The process of claim 1 wherein at least a portion of the material being evacuated from the cavity is recirculated back into the cavity through the material delivery system.

9. The process of claim 1 wherein opening and closing of the vent is controlled by an automatic mechanism.

10. The process of claim 1 further comprising repeating the steps of supplying, dissolving or reducing, venting, and evacuating until a desired concentration of first material is dissolved, reduced in density, or reduced in viscosity.

11. The process of claim 1 further comprising transporting the evacuated resulting material to a mixing tank.

12. The process of claim 1 further comprising recirculating at least a portion of the material in the mixing tank back into the cavity of the flexible bulk container.

13. The process of claim 12 further comprising repeating the steps of supplying, dissolving or reducing, venting, evacuating and recirculating until a desired concentration of first material is dissolved, reduced in density, or reduced in viscosity.

14. The process of claim 13 further comprising the step of raising a portion of the body to direct the resulting material to the at least one opening for evacuating the resulting material.

15. The process of claim 1 wherein the first material is an agricultural, fire fighting, food, pharmaceutical, chemical, energy, biological, safety, or cleaning material.

16. The process of claim 1 wherein the first material is a hazardous material.

17. The process of claim 16 wherein the first material is sodium cyanide.

18. A method for transporting bulk materials comprising the steps of:

providing a container assembly;

providing a removable reusable liner assembly, the liner assembly comprising:

a body defining a cavity;

at least one inlet for introducing a first material, at least one outlet, and at least one vent, each providing communication with the cavity; and a material delivery system assembly having:

at least one manifold, a portion of which is positioned within the cavity of the flexible bulk container, the at least one manifold having a shell, an interior region and an inlet accessible from outside of the cavity of the flexible bulk container and a plurality of passageways strategically positioned along the manifold extending from the internal region, through the shell, to, in turn, place the interior of the manifold in communication with the cavity, and wherein the at least one manifold is oriented within the flexible bulk container such that the outer shell of said manifold is coupled to each of a front and a back wall of the flexible bulk container and the passageways are positioned along at least one of a side wall of the flexible bulk container;

positioning the liner assembly within the container assembly at a first geographical location;

filling the cavity of the liner assembly with a first material through the at least one opening;

sealing the liner assembly;

transporting the container assembly to a second geographical location;

supplying the cavity of the liner assembly with a second liquid material through the material delivery system assembly;

dissolving, reducing in density, or reducing in viscosity the first material by contacting with the second material to form a resulting material;

evacuating the resulting material through the at least one opening of the liner assembly.

19. The method of claim 18 further comprising the step of raising a portion of the body to direct the resulting material to the at least one opening for evacuating the resulting material.

20. The method of claim 19 further comprising the step of removing the liner assembly from within the container assembly.

21. The method of claim 20 further comprising the step of reusing the liner assembly for transporting another bulk material.

22. The method of claim 20 wherein the liner assembly is returned to the first geographical location for reuse or is transported to a third geographical location for reuse.

23. The method of claim 19 wherein the first material comprises sodium cyanide.

* * * * *